US012366015B2

(12) United States Patent
Chen et al.

(10) Patent No.: US 12,366,015 B2
(45) Date of Patent: Jul. 22, 2025

(54) METHOD FOR PROCESSING ALL-POLYESTER FIBER COTTON-LIKE FABRIC WITH SUNLIGHT RESISTANCE

(71) Applicant: ZHEJIANG DONGJIN NEW MATERIAL CO., LTD., Shaoxing (CN)

(72) Inventors: Mingxian Chen, Shaoxing (CN); Lixin Sun, Shaoxing (CN); Zhuqing Cao, Shaoxing (CN); Pingping Xie, Shaoxing (CN)

(73) Assignee: ZHEJIANG DONGJIN NEW MATERIAL CO., LTD., Shaoxing (CN)

( * ) Notice: Subject to any disclaimer, the term of this patent is extended or adjusted under 35 U.S.C. 154(b) by 695 days.

(21) Appl. No.: 17/807,308

(22) Filed: Jun. 16, 2022

(65) Prior Publication Data

US 2023/0203722 A1 Jun. 29, 2023

(30) Foreign Application Priority Data

Dec. 28, 2021 (CN) ..... 202111625461.4

(51) Int. Cl.

| | |
|---|---|
| ***D03D 15/283*** | (2021.01) |
| ***D01F 8/16*** | (2006.01) |
| ***D06B 3/18*** | (2006.01) |
| ***D06B 3/20*** | (2006.01) |
| ***D06B 5/22*** | (2006.01) |
| ***D06B 21/00*** | (2006.01) |
| ***D06P 1/00*** | (2006.01) |
| ***D06P 1/16*** | (2006.01) |
| ***D06P 3/18*** | (2006.01) |
| ***D06P 3/54*** | (2006.01) |
| ***D06P 5/04*** | (2006.01) |
| ***D06P 5/20*** | (2006.01) |
| *D06M 15/643* | (2006.01) |
| *D06M 101/32* | (2006.01) |

(52) U.S. Cl.

CPC ..... *D03D 15/283* (2021.01); *D01F 8/16* (2013.01); *D06B 3/18* (2013.01); *D06B 3/20* (2013.01); *D06B 5/22* (2013.01); *D06B 21/00* (2013.01); *D06P 1/00* (2013.01); *D06P 1/16* (2013.01); *D06P 3/54* (2013.01); *D06P 5/04* (2013.01); *D06P 5/2066* (2013.01); *D06M 15/643* (2013.01); *D06M 2101/32* (2013.01); *D06M 2200/25* (2013.01)

(58) Field of Classification Search

CPC ..... D03D 15/283; D01F 8/16; D06B 3/18; D06B 3/20; D06B 5/22; D06B 21/00; D06P 1/00; D06P 1/16; D06P 3/54; D06P 5/04; D06P 5/2066; D06M 15/643; D06M 2101/32; D06M 2200/25

See application file for complete search history.

(56) References Cited

U.S. PATENT DOCUMENTS 5,004,643 A * 4/1991 Caldwell ..... C14C 11/00 442/88

2006/0040108 A1* 2/2006 Wang ..... C08G 77/52 252/588

FOREIGN PATENT DOCUMENTS

CN 104278386 A * 1/2015 ..... D02G 3/32

* cited by examiner

*Primary Examiner* — Amina S Khan

(74) *Attorney, Agent, or Firm* — Chiesa Shahinian & Giantomasi PC

(57) ABSTRACT

The present disclosure provides a method for processing an all-polyester fiber cotton-like fabric with sunlight resistance. The method includes: 1) weaving a PTT/PET bicomponent composite stretch yarn into a fabric; 2) dyeing processing the fabric; and 3) finalizing and finishing, wherein the finalizing and finishing comprises: a) preparing a finishing liquor obtained by mixing a crosslinking agent and an emulsion of benzophenone-containing polyorganosiloxane; b) padding the fabric; and c) drying and finalizing at a high temperature.

9 Claims, No Drawings

METHOD FOR PROCESSING ALL-POLYESTER FIBER COTTON-LIKE FABRIC WITH SUNLIGHT RESISTANCE

CROSS REFERENCE TO RELATED APPLICATION

This application claims the benefit and priority of Chinese Patent Application No. 202111625461.4, filed Dec. 28, 2021, the disclosure of which is incorporated herein by reference in its entirety.

FIELD

The present disclosure belongs to the technical field of textile fabrics, and specifically to a method for processing an all-polyester fiber cotton-like fabric with sunlight resistance.

BACKGROUND

Cotton fabrics have always been welcomed for their excellent hygroscopicity, softness, warmth retention and comfortableness. However, pure cotton fabrics have deficiencies in such as crease resistance, dirt resistance and mildew resistance. When the cotton fibers bring about a wet cold and discomfortable feeling after saturated absorption of human sweats, their disadvantages of poor wet permeability and poor quick-drying property after wet absorption appear. Polyester fibers with good shape retention and drapability are widely used in the production of cotton-like fabrics. Currently, the cotton-like fabrics are mostly made from polyester fibers and polyurethane fibers, which have the problems of nonresistance to acid and alkali, nonresistance to chlorine and nonresistance to sun exposure due to the presence of the polyurethane fibers.

SUMMARY

An objective of the present disclosure is to provide a method for processing an all-polyester fiber cotton-like fabric with sunlight resistance.

To achieve the above objective, the present disclosure provides the following technical solutions.

A method for processing an all-polyester fiber cotton-like fabric with sunlight resistance is provided, comprising:

1) weaving a PTT/PET (polytrimethylene terephthalate/polyethylene terephthalate) bicomponent composite stretch yarn into a fabric;
2) dyeing processing the fabric; and
3) finalizing and finishing, where the finalizing and finishing comprises:

a) preparing a finishing liquor obtained by mixing a crosslinking agent with an emulsion of benzophenone-containing polyorganosiloxane;
b) padding the fabric; and
c) drying and finalizing at a high temperature.

In some embodiments, the emulsion of benzophenone-containing polyorganosiloxane is prepared as follows:

adding 90 g of $D_4$ (octamethylcyclotetrasiloxane), 5 g of benzophenone-containing siloxane and 2 g of KH602 (3-(2-aminoethylamino)propyl-dimethoxymethylsilane) into a three-necked flask provided with an electric agitator, a thermometer and a reflux condenser, stirring and mixing evenly, and heating to 90° C. or higher; adding 0.2 g of a catalyst tetramethylammonium hydroxide, then holding at 120° C. for reacting for 6 h, and distilling under reduced pressure at a gauge pressure of 0.8 MPa to remove low-boiling residues; subsequently, heating to 140° C. to decompose the catalyst tetramethylammonium hydroxide, and distilling under reduced pressure at a gauge pressure of 0.8 MPa to remove low-boiling residues again so as to obtain a colorless, transparent and viscous liquid of benzophenone-containing polyorganosiloxane; then mixing the benzophenone-containing polyorganosiloxane with an emulsifier in a mass ratio of 10:1, adding a mixture of water and acetic acid under stirring, and stirring until the resultant is transparent to obtain the emulsion of benzophenone-containing polyorganosiloxane, where the emulsifier is composed of iso-tridecanol polyoxyethylene ether 1307, iso-tridecanol polyoxyethylene ether 1309 and fatty alcohol polyoxyethylene ether AEO-9 in a mass ratio of 2:2:1.

In some embodiments, the crosslinking agent is water-borne blocked polyurethane.

In some embodiments, the PTT/PET bicomponent composite stretch yarn in step 1) is a matt 100D/108F PET/PTT composite yarn with a mass ratio of PET to PTT of 1:1.

In some embodiments, the dyeing processing comprises procedures of scouring, pre-finalizing, alkali peeling and dyeing of the fabric.

In some embodiments, the scouring is conducted by treating the fabric at 100° C. for 30 min with a scouring agent of 2 g/L, a sodium carbonate concentration of 10 g/L and a bath ratio of 1:10.

In some embodiments, the pre-finalizing is conducted at a temperature in a range of 190-195° C. for 30-40 s.

In some embodiments, the alkali peeling is conducted by treating the fabric at 110° C. for 40 min with a NaOH mass concentration of 20 g/L and a bath ratio of 1:10.

In some embodiments, the dyeing is conducted as follows in sequence: adding a high-temperature levelling agent and an anti-creasing softener into a dye bath at normal temperature; treating the fabric in a dyeing machine for 10 min; adding a disperse dye and circulating a dye liquor for 10 min; heating to 75° C.; holding at 75° C. for 10 min; heating to 90° C.; holding at 90° C. for 15 min; heating to 130° C.; holding at 130° C. for 45 min; cooling to 50° C.; draining; washing with water; reduction clearing; washing with water; taking the fabric out of a vat.

In the method for processing an all-polyester fiber cotton-like fabric with sunlight resistance provided in the present disclosure, a PTT/PET bicomponent composite stretch yarn is woven into an all-polyester fiber stretch fabric, which has a cotton-like hand feeling, a desirable elasticity and superior properties to the conventional polyester fiber-polyurethane fiber fabrics. Meanwhile, since the fabric is free of polyurethane fibers, there are no problems of nonresistance to acid and alkali, nonresistance to chlorine and easy embrittlement under sun exposure. Fabrics of polyester fibers have a slightly poor light-fastness, and unfavorable phenomena such as fading may occur during serving of the fabrics. In view of this, in the present disclosure, an emulsion of benzophenone-containing polyorganosiloxane is used in post-finishing of the fabric to enhance the light-fastness, which also avoids the migration of conventional organic ultraviolet screening agents and the environmental problems caused by organofluorine. In addition, the crosslinking agent may react with the hydroxyl groups generated after alkali peeling of polyester fibers and the amino groups in polyorganosiloxane to form crosslinking, thereby improving the durability of the fabrics after finalizing and finishing.

DETAILED DESCRIPTION OF THE EMBODIMENTS

A method for processing an all-polyester fiber cotton-like fabric with sunlight resistance is provided, which comprises the following steps:

1) weaving a PTT/PET bicomponent composite stretch yam into a fabric;
2) dyeing processing the fabric; and
3) finalizing and finishing.

In step 1), the PTT/PET bicomponent composite stretch yarn is a matt 100D/108F PET/PTT composite yam with a mass ratio of PET to PTT of 1:1. The process of the weaving includes: for warp: raw material—sectional warping—leasing—healding and denting—weaving; for weft: raw material—weaving.

In step 2), the dyeing processing of the fabric comprises the procedures of scouring, pre-finalizing, alkali peeling and dyeing of the fabric.

The scouring is conducted by treating the fabric at 100° C. for 30 min with a scouring agent of 2 g/L, a sodium carbonate concentration of 10 g/L and a bath ratio of 1:10.

The pre-finalizing is conducted at a temperature in a range of 190-195° C. for 30-40 s.

The alkali peeling is conducted by treating the fabric at 110° C. for 40 min with a NaOH mass concentration of 20 g/L and a bath ratio of 1:10.

The dyeing is conducted as follows in sequence: adding a high-temperature levelling agent and an anti-creasing softener at room temperature; treating the fabric in a dyeing machine for 10 min; adding a disperse dye and circulating a dye liquor for 10 min; heating to 75° C. (at a heating rate of 1.5° C./min); holding at 75° C. for 10 min; heating to 90° C. (at a heating rate of 0.5° C./min); holding at 90° C. for 15 min; heating to 130° C. (at a heating rate of 1° C./min); holding at 130° C. for 45min; cooling to 50° C. (at a cooling rate of 1° C./min); draining; washing with water; reduction clearing; washing with water; taking the fabric out of a vat.

The finalizing and finishing is conducted specifically as follows:

a) preparing a finishing liquor, obtained by mixing a crosslinking agent and an emulsion of benzophenone-containing polyorganosiloxane in a mass ratio of 1:(18-20);
b) padding the fabric, performed by dipping twice and rolling twice with a pickup of 80-90%; and
c) drying and finalizing at a high temperature, performed by drying at 120° C. for 40-60 s and baking at a temperature in a range of 180-190° C. for 30-40 s.

The emulsion of benzophenone-containing polyorganosiloxane is prepared as follows:

adding 90 g of $D_4$, 5 g of benzophenone-containing siloxane and 2 g of KH602 into a three-necked flask provided with an electric agitator, a thermometer and a reflux condenser, then stirring and mixing evenly, and heating to 90° C. or higher; adding 0.2 g of tetramethylammonium hydroxide, then holding at 120° C. for reacting for 6 h, and distilling under reduced pressure at a gauge pressure of 0.8 MPa to remove low-boiling residues; subsequently, heating to 140° C. to decompose the catalyst tetramethylammonium hydroxide, and distilling under reduced pressure at a gauge pressure of 0.8 MPa to remove low-boiling residues again so as to obtain a colorless, transparent and viscous liquid, namely the benzophenone-containing polyorganosiloxane; mixing benzophenone-containing polyorganosiloxane with an emulsifier in a mass ratio of 10:1, adding a mixture of water and acetic acid under stirring, and stirring until the resultant is transparent to obtain emulsion of benzophenone-containing polyorganosiloxane. The emulsifier is composed of iso-tridecanol polyoxyethylene ether 1307, iso-tridecanol polyoxyethylene ether 1309 and AEO-9 in a mass ratio of 2:2:1. The emulsion is adjusted in pH with acetic acid to be acidic and has a mass percent of approximately 10%. The KH602 is 3-(2-aminoethylamino)propyl-dimethoxymethylsilane.

The benzophenone-containing siloxane above is prepared by the addition reaction of trimethoxysilane with 4-allyloxy-2-hydroxybenzophenone, which is performed by adding 28.2 g (0.1 mol) of 4-allyloxy-2-hydroxybenzophenone (CAS No. 2549-87-3), 80 g of toluene and 0.12 g of a platinum catalyst to a four-necked round-bottom flask provided with a mechanical agitator, a reflux condenser, a constant-pressure dropping funnel and a nitrogen-gas guide tube; heating to 85° C. and refluxing for 30 min under a nitrogen atmosphere; subsequently, weighing 14.7 g (0.12 mol) of trimethoxysilane (CAS No. 2487-90-3) and 10 g of toluene, fully mixing, then adding the resulting mixture to the four-necked round-bottom flask within 2 h via the constant-pressure dropping funnel; heating to 100° C. and holding for 6 h, cooling down, distilling off the unreacted monomers under a reduced pressure of 0.01 MPa, and discharging to obtain the benzophenone-containing siloxane.

The crosslinking agent is waterborne blocked polyurethane as a commercially available product, such as waterborne blocked isocyanate curing agent BL5335 (Covestro AG, Germany).

EXAMPLE 1

An all-polyester fiber cotton-like fabric was prepared, which included warps and wefts. Both the warps and the wefts were matt 100D/108F PET/PTT composite yarns with a mass ratio of PET to PTT of 1:1. The technological process of the weaving included: for warp: raw material—sectional warping—leasing—healding and denting—weaving; for weft: raw material—weaving.

The parameters of the warping were as follows: a warp specification of 100D/108F composite yarn, 150 T/m·Z; a total warp count of 7,416; a width of 206 cm; an upper row number of 618; a branch number of 12; a stentering strip width of 17 cm; 2 warps per 18-feather reed; an angle of 90°; a winding tension of 2 kg.

The parameters of the weaving were as follows: a loom speed of 800 r/min; a warp stop-frame depth of 5; a heald levelling time of inner warp of 340°; an opening travel of 24°; a loom setting tension of 100 KN; a weft selection of 1; a loom setting weft density of 27 wefts/cm.

The specification of the all-polyester fiber cotton-like fabric were as follows:

Width: 206 cm
Warp/weft density: 36 warps/27 wefts per cm
Reed number: 18 #
Warp per reed: 2
Total warp count: 7,416 warps
Selvedge warp count: 60×2=120 warps
Warp: matt 100D/108F PET/PTT composite yarn in a mass ratio of PET to PTT of 1:1
Weft: matt 100D/108F PET/PTT composite yarn in a mass ratio of PET to PTT of 1:1
Healding: 1-4 straight drafting
Card: plain weave
Weight per meter: 154 g/m

EXAMPLE 2

The dyeing processing of the all-polyester fiber cotton-like fabric prepared in Example 1 was conducted, including the procedures of scouring, pre-finalizing, alkali peeling and dyeing of the fabric.

1) Scouring

The formulation and conditions of the scouring were as follows:

a scouring agent of 2 g/L, a sodium carbonate concentration of 10 g/L, a bath ratio of 1:10, and the fabric was dipped in the scouring agent at room temperature, then heated to 100° C. at a rate of 1.5° C./min, held at 100° C. for 30 min, cooled to 50° C. or lower at a rate of 2° C./min, followed by neutralized with an acid, and washed with water twice until the surface of the fabric was neutral.

2) Pre-Finalizing

The conditions of the pre-finalizing were as follows:

temperature/° C.: 190-195, time/s: 30-40, and loom speed/(m/min): 30.

3) Alkali Peeling

The formulation and conditions of the alkali peeling were as follows:

a NaOH mass concentration of 20 g/L, a bath ratio of 1:10, a treatment time of 40 min, a treatment temperature of 110° C., and the fabric was dipped in the alkali solution at room temperature, then heated to 110° C. at a rate of 1° C./min, held at 110° C. for 40 min, cooled to 50° C. or lower at a rate of 2° C./min, followed by neutralized with an acid, and washed with clean water until the surface of the fabric was neutral.

4) Dyeing

The formulation of the dyeing was as follows:

disperse dye/% (owf): x, high-temperature levelling agent/$g \cdot L^{-1}$: 1, anti-creasing softener/$g \cdot L^{-1}$: 0.5, pH value (adjusted with glacial acetic acid): 5.5 to 6.5, a bath ratio of 1:10.

The conditions and flow path of the dyeing were as follows:

the high-temperature levelling agent and the anti-creasing softener were added at room temperature→the fabric was treated in a dyeing machine for 10 min →the disperse dye was added and the resulting dye liquor was circulated for 10 min→heated to 75° C. (at a rate of 1.5° C./min)→held at 75° C. for 10 min→heated to 90° C. (at a rate of 0.5° C./min)→held at 90° C. for 15 min→heated to 130° C. (at a rate of 1° C./min)→held at 130° C. for 45 min→cooled to 50° C. (at a rate of 1° C./min)→drained→washed with water→reduction cleared→washed with water→the fabric was taken out of a vat.

After dyeing, the fabric was reduction cleared, which could remove the floating color on the fiber surface and improve the indicators of colorfastness.

The formulation and conditions of the reduction clearing were as follows:

2 g/L of sodium hydrosulfite, 2 g/L of sodium carbonate, a bath ratio of 1:10, temperature: 85° C., and time: 10 min.

After reduction clearing, the fabric was neutralized with acetic acid and washed with warm water and cold water, respectively.

EXAMPLE 3

A method for processing an all-polyester fiber cotton-like fabric with sunlight resistance was performed as follows:

1) a PTT/PET bicomponent composite stretch yarn was woven into a fabric, and the specific steps were the same as those in Example 1;

2) the fabric was dyeing processed, and the specific steps were the same as those in Example 2;

3) the fabric was finalized and finished as follows:

a) a finishing liquor was prepared, which was an emulsion of benzophenone-containing polyorganosiloxane;

b) the fabric was padded, which was performed by being dipped twice and rolled twice with a pickup of 80-90%;

c) the fabric was dried and finalized at a high temperature, which was performed by being dried at 120° C. for 40-60 s and baked at 180-190° C. for 30-40 s.

The grade of water repellency was 5 before washing and was 3 after washing five times; the elasticity elongation rate was ≥20%, and the elasticity recovery rate was ≥85%; the grade of colorfastness to light was in a range of 4 to 5.

EXAMPLE 4

A method for processing an all-polyester fiber cotton-like fabric with sunlight resistance was performed as follows:

1) a PTT/PET bicomponent composite stretch yarn was woven into a fabric, and the specific steps were the same as those in Example 1;

2) the fabric was dyeing processed, and the specific steps were the same as those in Example 2;

3) the fabric was finalized and finished as follows:

a) a finishing liquor was prepared, which was prepared by mixing a waterborne blocked isocyanate curing agent BL5335 and an emulsion of benzophenone-containing polyorganosiloxane emulsion in a mass ratio of 1:20;

b) the fabric was padded, which was performed by being dipped twice and rolled twice with a pickup of 80-90%;

c) the fabric was dried and finalized at a high temperature, which was performed by being dried at 120° C. for 40-60 s and baked at 180-190° C. for 30-40 s.

The grade of water repellency was 5 before washing and was 4 after washing five times; the elasticity elongation rate was ≥16%, and the elasticity recovery rate was ≥83%; the grade of colorfastness to light was in a range of 4 to 5.

EXAMPLE 5:

A method for processing an all-polyester fiber cotton-like fabric with sunlight resistance was performed as follows:

1) a PTT/PET bicomponent composite stretch yarn was woven into a fabric, and the specific steps were the same as those in Example 1;
2) the fabric was dyeing processed, and the specific steps were the same as those in Example 2;
3) the fabric was finalized and finished as follows:
a) a finishing liquor was prepared, which was prepared by mixing a waterborne blocked isocyanate curing agent BL5335 and an emulsion of benzophenone-containing polyorganosiloxane in a mass ratio of 1:18;
b) the fabric was padded, which was performed by being dipped twice and rolled twice with a pickup of 80-90%;
c) the fabric was dried and finalized at a high temperature, which was performed by being dried at 120° C. for 40-60 s and baked at 180-190° C. for 30-40 s.

The grade of water repellency was 5 before washing and was 4 after washing five times; the elasticity elongation rate was ≥12%, and the elasticity recovery rate was ≥80%; the grade of colorfastness to light was in a range of 4 to 5.

In the all-polyester fiber cotton-like fabric with sunlight resistance prepared according to the method of the present disclosure, the cotton-like effect is synthetically formed by weaving, dyeing and post-finishing. In the weaving, the mass ratio of PET/PTT components in warps and wefts, fineness, twist and warp/weft density are the major influencing factors; in the subsequent dyeing processing, both the conditions of pre-finalizing and the rate of alkali peeling have direct effects on the style and hand feeling of the fabric products; and in the post-finishing, the siloxane emulsion contributes to the soft hand feeling of fabrics and the waterproof and sunlight resistant properties.

Testing methods for the performance indicators as mentioned above were as follows: water repellency was tested under GB/T 4745-2012 "*Textiles—Testing and Evaluation for Water Resistance—Spray Test Method*"; elasticity was tested under FZ/T 01034-2008 "*Textiles—Test Method of the Tensile Elasticity for Woven Fabrics*"; colorfastness to light was tested under GB/T 8427-2019 "*Textiles—Tests for Color Fastness—Color Fastness to Artificial Light: Xenon Arc* ".

What is claimed is:

1. A method for processing an all-polyester fiber cotton-like fabric with sunlight resistance, comprising:

1) weaving a PTT/PET (polytrimethylene terephthalate/polyethylene terephthalate) bicomponent composite stretch yarn into a fabric;
2) dyeing processing the fabric; and
3) finalizing and finishing, wherein the finalizing and finishing comprises:

a) preparing a finishing liquor obtained by mixing a crosslinking agent and an emulsion of benzophenone-containing polyorganosiloxane;
b) padding the fabric; and
c) drying and finalizing at a high temperature.

2. The method according to claim 1, wherein the emulsion of benzophenone-containing polyorganosiloxane is prepared as follows:

adding 90 g of D4 octamethylcyclotetrasiloxane, 5 g of benzophenone-containing siloxane and 2 g of 3-(2-aminoethylamino)propyl-dimethoxymethylsilane into a three-necked flask provided with an electric agitator, a thermometer and a reflux condenser, then stirring and mixing evenly, and heating to 90° C. or higher; adding 0.2 g of a catalyst tetramethylammonium hydroxide, then holding at 120° C. for reacting for 6 h, and distilling under reduced pressure at a gauge pressure of 0.8 MPa to remove residues; subsequently, heating to 140° C. to decompose the catalyst tetramethylammonium hydroxide, and distilling under reduced pressure at a gauge pressure of 0.8 MPa to remove residues again so as to obtain a colorless, transparent and viscous liquid of benzophenone-containing polyorganosiloxane; then mixing the benzophenone-containing polyorganosiloxane with an emulsifier in a mass ratio of 10:1, adding a mixture of water and acetic acid under stirring, and stirring until the resultant composition is transparent to obtain the emulsion of benzophenone-containing polyorganosiloxane, wherein the emulsifier is composed of iso-tridecanol polyoxyethylene ether 1307, iso-tridecanol polyoxyethylene ether 1309 and fatty alcohol polyoxyethylene ether AEO-9 in a mass ratio of 2:2:1.

3. The method according to claim 1, wherein the crosslinking agent is waterborne blocked polyurethane.

4. The method according to claim 1, wherein the PTT/PET bicomponent composite stretch yam in step 1) is a matt 100D/108F PET/PTT composite yarn with a mass ratio of PET to PTT of 1:1.

5. The method according to claim 1, wherein the dyeing processing comprises procedures of scouring, pre-finalizing, alkali peeling and dyeing of the fabric.

6. The method according to claim 5, wherein the scouring is conducted under the following formulation and conditions: treating the fabric at 100° C. for 30 min with a scouring agent of 2 g/L, a sodium carbonate concentration of 10 g/L and a bath ratio of 1:10.

7. The method according to claim 5, wherein the pre-finalizing is conducted at a temperature in a range of 190-195° C. for 30-40 s.

8. The method according to claim 5, wherein the alkali peeling is conducted under the following formulation and conditions: treating the fabric at 110° C. for 40 min with a NaOH mass concentration of 20 g/L and a bath ratio of of the fabric to NaOH solution 1:10.

9. The method according to claim 5, wherein the dyeing is conducted as follows in sequence: preparing a formulation by adding a levelling agent and an anti-creasing softener at room temperature; treating the fabric with the formulation in a dyeing machine for 10 min; adding a disperse dye to the formulation to form a dye liquor and circulating the dye liquor for 10 min; heating the dye liquor to 75° C., holding the dye liquor at 75° C. for 10 min; heating the dye liquor to 90° C., holding the dye liquor at 90° C. for 15 min; heating the dye liquor to 130° C., holding the dye liquor at 130° C. for 45 min; cooling the dye liquor to 50° C.; draining the dye liquor; washing the fabric with water; reduction clearing the fabric; washing the fabric with water in a vat; and taking the fabric out of the vat.

* * * * *